US008119942B2

(12) United States Patent
Yang et al.

(10) Patent No.: US 8,119,942 B2
(45) Date of Patent: Feb. 21, 2012

(54) CIRCUIT BREAKER HAVING DELAYING FUNCTION FOR ROTATION OF CAM

(75) Inventors: Hong-Ik Yang, Chungcheongbuk-Do (KR); Kil-Young Ahn, Daejeon (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 244 days.

(21) Appl. No.: 12/641,838

(22) Filed: Dec. 18, 2009

(65) Prior Publication Data

US 2010/0163380 A1 Jul. 1, 2010

(30) Foreign Application Priority Data

Dec. 31, 2008 (KR) ..... 10-2008-0138522

(51) Int. Cl.
*H01H 43/00* (2006.01)

(52) U.S. Cl. ..... 200/33 B; 200/400; 200/401

(58) Field of Classification Search ..... 200/33 B, 200/400–401, 337, 500, 501, 293, 573, 574, 200/303, 307, 308; 335/165, 6, 8, 21, 167, 335/171, 189–191, 17
See application file for complete search history.

(56) References Cited

U.S. PATENT DOCUMENTS

| | | | | |
|---|---|---|---|---|
| 4,264,796 | A * | 4/1981 | Nelson et al. | 200/400 |
| 4,968,863 | A * | 11/1990 | Rezac et al. | 200/401 |
| 5,224,590 | A | 7/1993 | Milianowicz et al. | |
| 5,504,290 | A * | 4/1996 | Baginski et al. | 200/401 |
| 6,472,627 | B1 * | 10/2002 | Yoon | 200/400 |
| 7,397,008 | B2 * | 7/2008 | Ahn et al. | 200/400 |
| 2005/0231308 | A1 | 10/2005 | Kim | |
| 2008/0122563 | A1 | 5/2008 | Song | |

FOREIGN PATENT DOCUMENTS

| | | |
|---|---|---|
| EP | 1939903 | 7/2008 |
| KR | 20-0442291 | 10/2008 |

OTHER PUBLICATIONS

Korea Office action, mail date is Sep. 2010.

* cited by examiner

*Primary Examiner* — Edwin A. Leon
(74) *Attorney, Agent, or Firm* — Greenblum & Bernstein P.L.C.

(57) ABSTRACT

Disclosed is a circuit breaker having a cam rotation delaying function employed to block current, the circuit breaker performing a charging operation and a charting operation, the circuit breaker including a closing spring having one end portion rotatably coupled to each of plates, a driving lever rotatably installed at each of the plates and connected to another end portion of the closing spring so as to be rotated responsive to compression and extension of the closing spring, a cam rotatably installed at each of the plates and configured to press the driving lever for rotation, a link mechanism having a plurality of links rotatably installed at each of the plates and connected to the driving lever for operation, a movable contact rotatably installed at a side of each of the plates and contactable with a terminal by an operation of the link mechanism, and a cam delaying mechanism installed at each of the plates and configured to attenuate a rotational force of the cam due to a restoring force of the closing spring, whereby an excessive rotation of the cam can be prevented by the cam delaying mechanism so as to allow stable and complete toggling operation of the link mechanism and a smooth restoring operation of the closing spring, thereby providing more stable operation of the circuit breaker.

11 Claims, 7 Drawing Sheets

CIRCUIT BREAKER HAVING DELAYING FUNCTION FOR ROTATION OF CAM

CROSS-REFERENCE TO RELATED APPLICATION

Pursuant to 35 U.S.C. §119(a), this application claims the benefit of earlier filing date and right of priority to Korean Application No. 10-2008-0138522, filed on Dec. 31, 2008, the contents of which is incorporated by reference herein in its entirety.

BACKGROUND OF THE INVENTION

1. Field of the Invention

The present invention relates to a circuit breaker having a cam rotation delaying function, and particularly, to a circuit breaker having a cam rotation delaying function capable of avoiding incomplete closing operation due to a rotation of a cam in a state of mechanically performing an ON/OFF operation for a load side by virtue of the rotatable cam.

2. Background of the Invention

In general, a circuit breaker is an apparatus for blocking a circuit upon occurrence of overload, short-circuit, electric leakage and electric shock by selectively switching on or off a circuit between a power source side and a load side. A construction of a circuit breaker is disclosed in the Korean Registered utility model application No. 20-0442291.

As disclosed in Korean Registered utility model application No. 20-0442291, a circuit breaker executes a charging operation for accumulating elastic energy in a closing spring, a closing operation for connecting a movable contact to a terminal by an elastic restoring force of the closing spring, and an opening operation for separating the movable contact from the terminal.

Here, the charging operation is executed as follows. That is, in a blocked state where the movable contact is separated from the terminal, a cam is rotated responsive to rotation of rotational shaft which is rotated manually or rotates automatically, and a driving lever contacted by the cam is rotated in cooperation with the rotation of the cam. Accordingly, the closing spring is compressed by the rotation of the driving lever.

The closing operation is executed as follows. Elastic energy of the closing spring is transferred to a link member of a switching mechanism such that a switching shaft connected to a third link is rotated. A leg rotated in cooperation with the rotation of the switching shaft makes the movable contact moved toward the terminal so as to come in contact with the terminal, thereby enabling current flow. During the closing operation, a connection shaft of an opening spring installed at a lower portion of the leg is moved toward the terminal, accordingly the opening spring is extended.

Here, the opening operation is executed as follows. The leg is reversely rotated by an elastic restoring force of the opening spring which has been extended during the closing operation and the movable contact is spaced from the terminal to be returned to its original location.

Here, the link member is a toggle member including a first link, a second link and a third link, and performs a toggling operation capable of enduring a repulsive load which is generated upon the closing operation of the movable contact with respect to the terminal. The first and second links are rotatably connected to each other by a first rotation pin, and the second and third links are rotatably connected to each other by a second rotation pin.

Regarding the charging operation of the thusly configured circuit breaker, when the closing spring is compressed during a closing operation, a restoring force of the closing spring is applied to a cam via a bearing pin, which is disposed at the driving lever so as to be contactable with the driving lever and the cam.

Regarding the closing operation, a restoring force of the closing spring rotates the cam in a clockwise direction based upon a cam shaft when a closing latch of a driving mechanism is rotated and accordingly the closing spring in a compressed state is extended.

Here, if a force of the closing spring is set greater than a force required for returning the cam to its original location, a force applied to the cam during the closing operation becomes greater accordingly and a rotational force of the cam in the clockwise direction becomes excessive. As a result, upon rotating back to its original location, the cam is rotated over the original location in the clockwise direction, thereby being rotated up to a location interfering with a returning rotation of the driving lever.

That is, upon the closing operation, the cam may interfere with the rotation of the driving lever and a toggle pin of the link member is located above the first link to thereby suppress a complete toggle operation. Further, the returning rotation of the driving lever is suspended by the cam, and accordingly a stopping pin of the driving lever cannot be moved up to a second support shaft, which is disposed at a lower side of the driving lever for supporting the stopping pin, resulting in disabling the closing spring to be extended to its original state.

Consequently, the related art circuit breaker has a problem in that the cam may be rotated up to an excessive location by a preset tensile force of the closing spring, thereby having the chance of being operated in an unstable state.

SUMMARY OF THE INVENTION

Therefore, to obviate the problems of the related art, an object of the present invention is to provide a circuit breaker having a cam rotation delaying function capable of ensuring more stable operation in terms of allowing a toggling operation of a link mechanism to be stably completely performed and ensuring smooth returning of a closing spring by preventing an excessive rotation of a cam.

To achieve these and other advantages and in accordance with the purpose of the present invention, as embodied and broadly described herein, there is provided a circuit breaker having a cam rotation delaying function, the circuit breaker performing a closing operation and a charging operation, the circuit is breaker including, a plurality of plates spaced apart from each other, a closing spring having one end portion rotatably coupled to each of the plates, a driving lever rotatably installed at each of the plates and connected to another end portion of the closing spring so as to be rotated responsive to compression and extension of the closing spring, a cam rotatably installed at each of the plates and configured to press the driving lever for rotation, a link mechanism having a plurality of links rotatably installed at each of the plates and connected to the driving lever for operation, a movable contact rotatably installed at a side of each of the plates and contactable with a terminal by an operation of the link mechanism, and a cam delaying mechanism installed at each of the plates and configured to attenuate a rotational force of the cam due to a restoring force of the closing spring.

Here, the cam delaying mechanism may include a delay link elastically rotatably installed at each of the plates and configured to delay the rotation of the cam.

The cam delaying mechanism may include a delay link rotatably installed at each of the plates and contactable with the supplementary cam, a rotation pin inserted into the delay link to be coupled to the plate so as to transfer a rotation of the delay link, and a delay spring installed between the delay link and each plate and configured to elastically support the rotation of the delay link.

The delay link may include a supporting portion protrudingly formed and slidably inserted into an outer circumferential portion of the supplementary cam.

A contact portion of the delay link with the supplementary cam may be formed to be round.

The delay link may include an accommodation groove, wherein the delay spring comprises a first stopper locked at the accommodation groove and a is second stopper locked at the plate.

The supplementary cam may include a contact groove in which the delay link is detachably inserted.

The supplementary cam may be installed at both sides of the rotational shaft, and provided with coupling holes formed along a central portion of the cam, the cam being coupled to the coupling holes.

In another aspect of the present invention, there is provided a circuit breaker having a cam rotation delaying function, in a circuit breaker performing a closing operation and a charging operation, the circuit breaker including, a plurality of plates spaced apart from each other, a closing spring having one end portion rotatably coupled to each of the plates, a damper installed within the closing spring and contracted and extended in cooperation with the closing spring to attenuate a restoring force of the closing spring, a driving lever rotatably installed at each of the plates and connected to another end portion of the closing spring so as to be rotated responsive to compression and extension of the closing spring, a cam rotatably installed at each of the plates and configured to press the driving lever for rotation, a supplementary cam installed at the same rotational shaft as that of the cam so as to be cooperatively rotated with the cam and having a rotational radius greater than that of the cam, a link mechanism having a plurality of links rotatably installed between the plates by virtue of toggle pins and connected to the driving lever so as to be toggled, and a movable contact rotatably installed at a side of each of the plates and contactable with a terminal by an operation of the link mechanism.

The damper may be configured as dual pipes slidably coupled to each other so as to be contracted and extended.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a circuit breaker having a cam rotation delaying function in accordance with the preferred embodiments of the present invention, with reference to the accompanying drawings.

Figure 1:
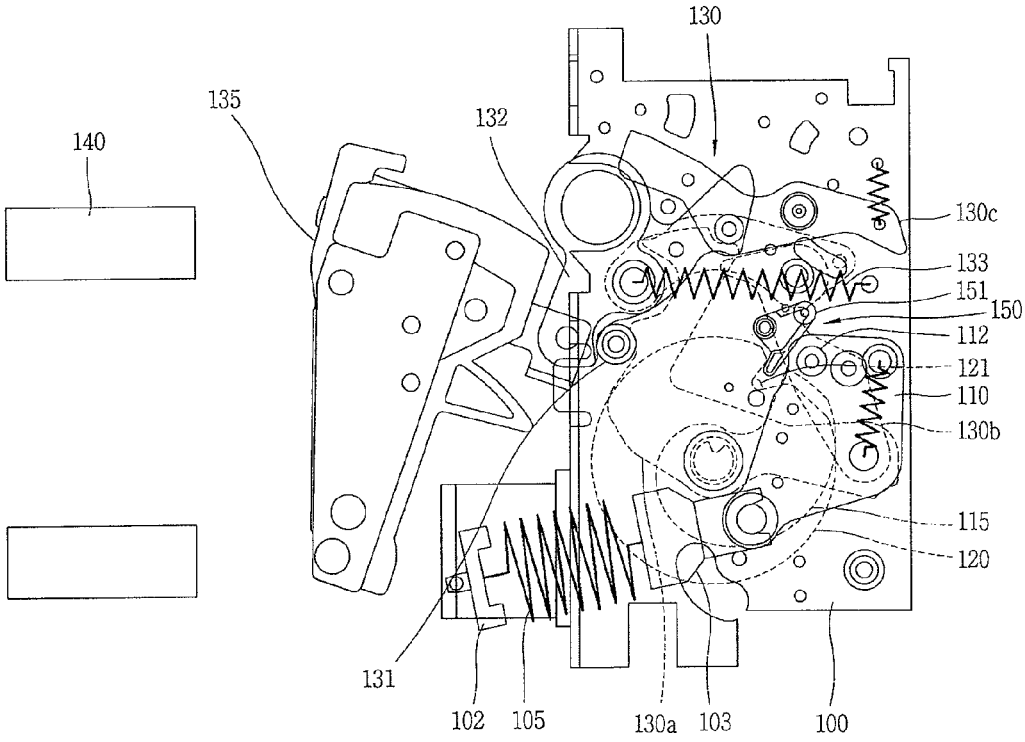
FIG. 1 is an internal front view of a circuit breaker having a cam rotation delaying function in accordance with one embodiment of the present invention.
Figure 2:
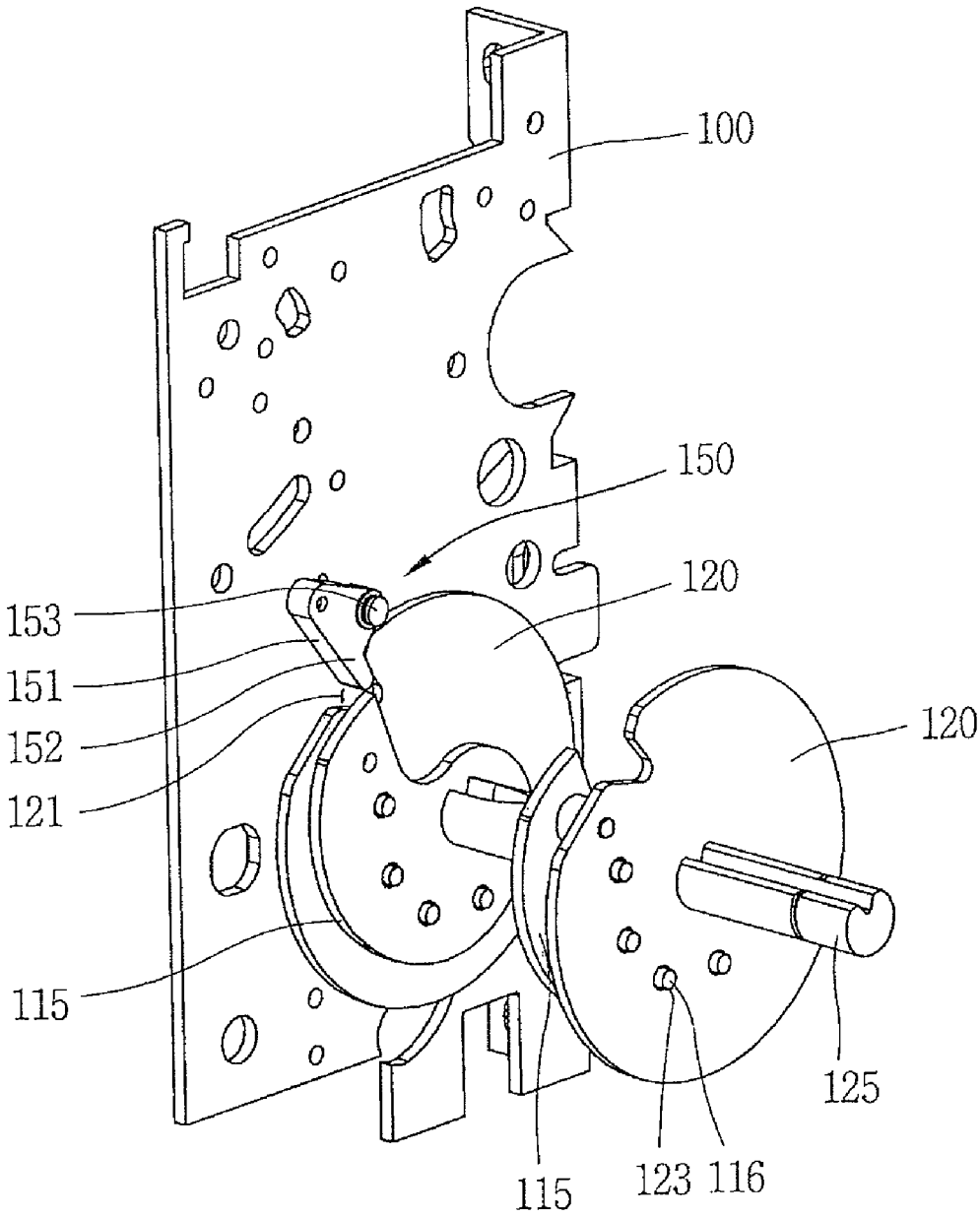
FIG. 2 is a perspective view showing a contact state of a supplementary cam by virtue of a cam delaying mechanism of FIG. 1.

As shown in FIGS. 1 and 2, a circuit breaker having a cam rotation delaying function in accordance with one embodiment of the present invention may include a plate 100, a closing spring 105, a driving lever 110, a cam 115, a supplementary cam 120, a link mechanism 130, a terminal 140, a movable contact 135 and a cam delaying mechanism 150.

Here, the plate 100 may be provided in pair to be spaced apart from each other. FIGS. 1 and 2 show one plate 100 in a separated state. Here, the closing spring 105 may be disposed, having one end portion rotatably coupled to a lower portion of the plate 100. A rotatable circular plate 102 rotatably coupled to the plate 100 may be coupled to a left end of the closing spring 105, and the cam 103 rotatably coupled to the driving lever 110 may be disposed at a right end of the closing spring 105.

Referring to FIG. 1, the driving lever 110 may have an upper portion rotatably installed at the plate 100 and be connected to a right end portion of the closing spring 105. The driving lever 110 may be configured to be rotated in a clockwise direction in a state of the closing spring 105 being compressed and rotated in a counterclockwise direction in a state of the same being extended.

Also, the cam 115 which presses the driving lever 110 for rotation may be rotatably installed at the plate 110. The cam 115 may be rotated in a clockwise is direction by an external force so as to press a bearing 112 installed at a left upper portion of the driving lever 110. As a rotational radius of the cam 115 contacted by the bearing 112 is increased, the bearing 112 is pushed up such that the driving lever 110 can be rotated in the clockwise direction.

Referring to FIG. 2, the supplementary cam 120 may be connected to the cam 115. The supplementary cam 120 may be installed at the same rotational shaft as that of the cam 115 so as to be cooperatively rotated with the cam 115 and formed to have a rotational radius greater than that of the cam 115. The supplementary cam 120 may physically cooperate with a display on which a compressed state and an extended state of the closing spring 105 are visibly displayed.

Figure 5:
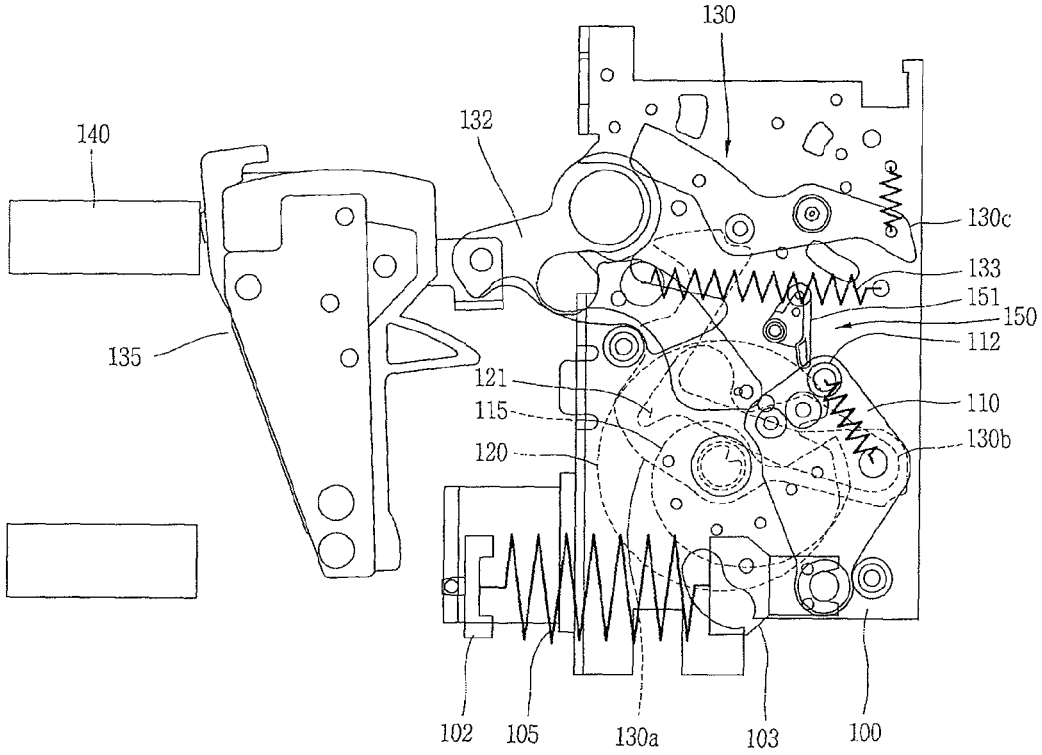
FIG. 5 is a view showing a completely closed state from the state of FIG. 1.

Referring to FIGS. 1 and 5, the link mechanism may be provided with a plurality of links rotatably installed at the plate 100 by toggle pins 131 and toggled in a connected state with the driving lever 110. The link mechanism 130 may include three links 130*a*, 130*b* and 130*c* cooperative with the driving lever 110. During a charging operation, the driving lever 110 is rotated clockwise and accordingly the closing spring 104 is compressed, thereby securing one link 130*a*. The other two links 130*b* and 130*c* may be rotated toward the secured one link 130*a* when the driving lever 110 is rotated counterclockwise by extension of the compressed closing spring 105 upon a closing operation. Accordingly, a leg 132 connected to the movable contact 135 is allowed to be rotated in a clockwise direction. The link mechanism 130 is a known component of an air circuit breaker, so its detailed configuration and operation will not be explained.

The movable contact 135 which is rotated toward the terminal 140 by the leg 132 cooperative with the link mechanism 130 may be rotatably disposed at a side of the plate 100. When the movable contact 135 is rotated counterclockwise responsive to extension of the closing spring 105 which was in the compressed (charged) state, the movable contact 135 cooperates with the link mechanism 130 to be in contact with the terminal 140. Also, the leg 132 is rotated in the counterclockwise direction by the tensile force of the opening spring 133 such that the movable contact 135 is separated from the terminal 140. The separation of the movable contact 135 from the terminal 140 may allow cut-off of power applied to a load side.

When the closing spring 105 is extended from the compressed state, the cam 115 is rotated in the clockwise direction by the bearing 112 of the driving lever 110 so as to be returned to a state just before the charging operation. Here, the cam 115 should be rotated until before it passes over the closing spring 105 by pressurization of the bearing 112 due to the extension of the closing spring 105. If the closing spring 105 applies an excessive elastic force, the cam 115 is rotated over 180°. Accordingly, the cam may be rotated until supporting the bearing 112 of the driving lever 110 by the portion having the shortest rotational radius. In a state where the bearing 112 of the driving leer 110 is interfered with the clockwise rotation of the cam 115, the driving lever 110 cannot be rotated in the counterclockwise direction any more, and thereby cannot be returned to its original location.

Hence, a configuration of delaying a rotating speed of the cam 115 when the cam 115 is rotated responsive to the extension of the closing spring 105 is needed. Here, it may also be possible to directly control the rotating speed of the cam 115. The rotating speed of the cam 115 can be controlled to be delayed by reducing the rotating speed of the supplementary cam 120 coupled to the cam 115. That is, the cam delaying mechanism 150 may be installed at an upper side of the supplementary cam 120. The cam delaying mechanism 150 may contact the supplementary cam 120 so as to delay the rotating speed of the supplementary cam 120 at a rotation interval in which the cam 115 is returned.

Figure 3:
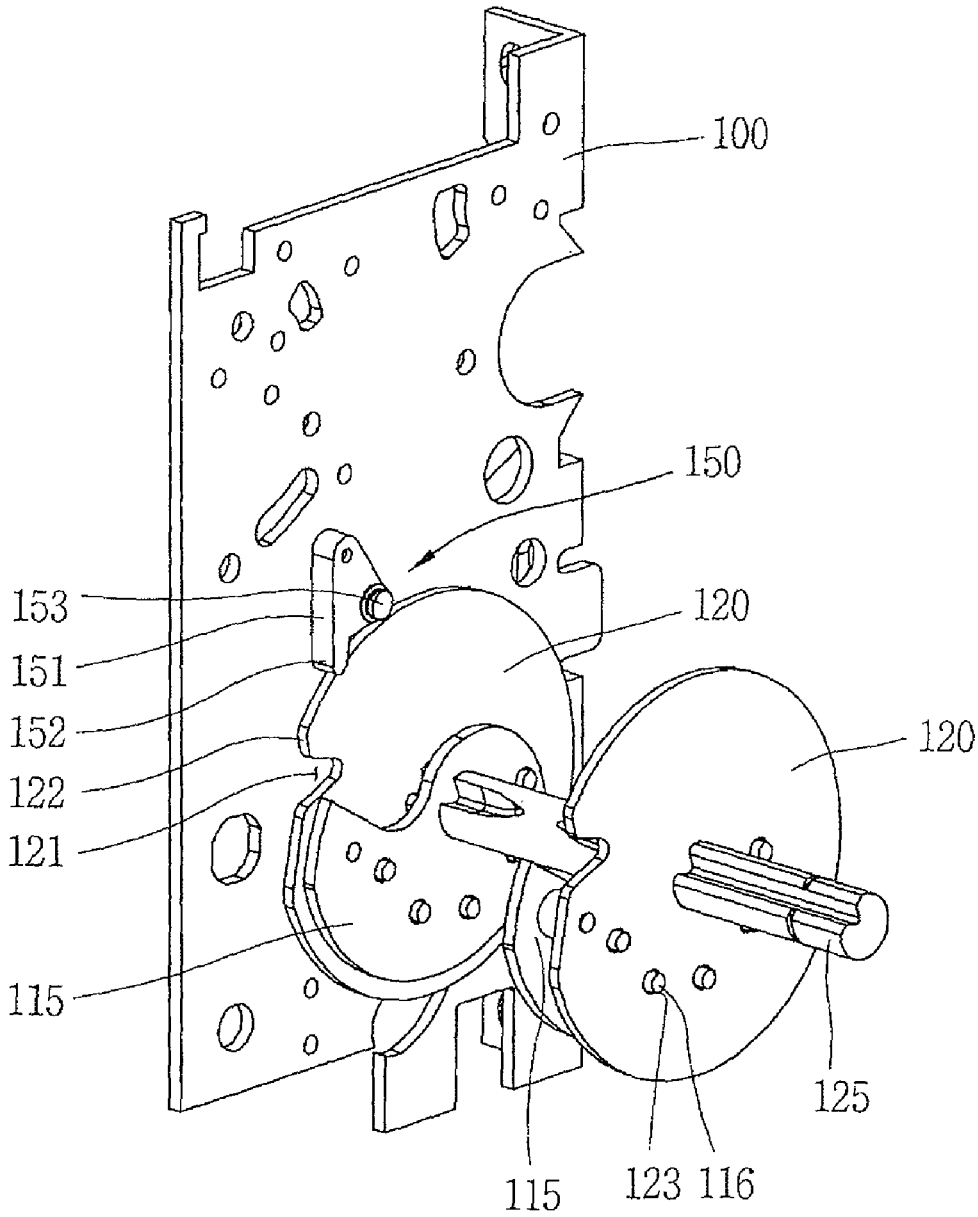
FIG. 3 is a view showing a delayed state of the cam due to the cam delaying mechanism of FIG. 2.
Figure 4:
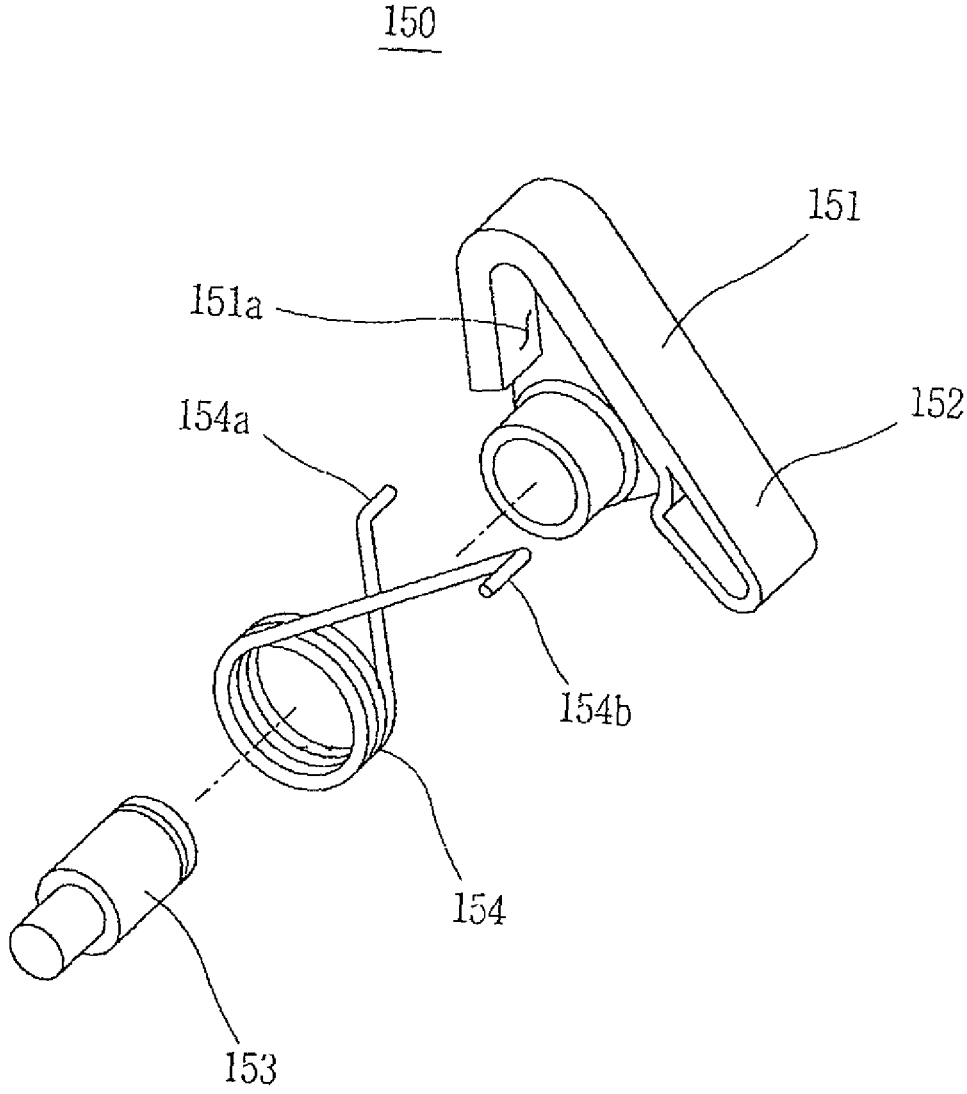
FIG. 4 is a disassembled perspective view of the cam delaying mechanism of FIG. 2.

Here, referring to FIGS. 2 to 4, the cam delaying mechanism 150 may be rotatably installed at the plate 100, and include a delay link 151 contacted by the supplementary cam 120, a rotation pin 153 inserted into the delay link 151 to be coupled to the plate 100 and allowing the rotation of the delay link 151, and a delay spring 154 installed between the delay link 151 and the plate 100 for elastically supporting the rotation of the delay link 151. The rotation pin 153 may be inserted into a right side of the delay link 151 to be coupled to the plate 100, and the delay link 151 may be rotatable in the coupled state with the rotation pin 151. Here, the delay link 151 may include an accommodation groove 151*a*, and the delay spring 154 may include a first stopper 154*a* locked at the accommodation groove 151*a* and a second stopper 154*b* locked at the plate 100.

Still referring to FIGS. 2 and 4, the clockwise rotation of the delay link 151 may be supported by the delay spring 154. The delay link 151 may include a supporting portion 152 protruded to be inserted into an outer circumferential portion of the supplementary cam 120. An end portion of the supporting portion 152 may be formed to be round, which facilitates a slidable movement at the inserted portion of the supplementary cam 120.

Still referring to FIGS. 2 and 3, the supplementary cam 120 may include a contact groove 121 in which the supporting portion 152 of the delay link 151 is detachably inserted and formed to be supported by the supporting portion 152. When the supplementary cam 120 is rotated, because the supporting potion 152 of the delay link 151 is in an inserted state in the contact groove 121, the rotation of the supplementary cam 120 may be suspended by the delay link 151. The rotating speed of the supplementary cam 120 is reduced until the supporting portion 152 is slid out of the contact groove 121 up to an outer circumferential portion of the contact groove 121.

That is, the rotation of the supplementary can 120 is delayed within an interval from the supporting portion 152 being moved along an internal surface of the contact groove 121 up to reaching an outer circumferential surface of the contact groove 121. The delay link 151 may function to obstruct the rotation of the cam 115 so as to prevent an excessive rotation of the cam 115 when the driving lever 110 is rotated by an initial tensile force of the closing spring 105. Also, tilt surfaces configuring the contact groove 121 may be formed such that a tilt surface at the side of a guide surface 122 of the contact groove 121 is more sharply inclined. Here, the guide surface 122 formed at an upper portion of the contact groove 121 may ensure a smooth movement of the supporting portion 152 to the outer circumferential portion of the cam 115.

In the meantime, the supplementary cam 120 may be installed at both sides of the rotational shaft 125. The supplementary cam 120 may be provided with coupling holes 123 to which the cam 115 is coupled. The coupling holes 123 may be formed along a central portion of the cam 115. The cam 115 may be provided with insertion protrusions 116 inserted into the coupling holes 123. The cam 115 and the supplementary cam 120 may be firmly coupled by the insertion protrusions 116 and the coupling holes 123 disposed conformable to the shape of the cam 115, thus to endure the pressure applied by the bearing 112 of the driving lever 110.

As such, the rotation of the supplementary cam 112 can be delayed by the delay link 151 supported at the contact groove 121 of the supplementary cam 120, and the rotation of the cam 115 coupled to the supplementary cam 120 can be cooperatively delayed.

Figure 6:
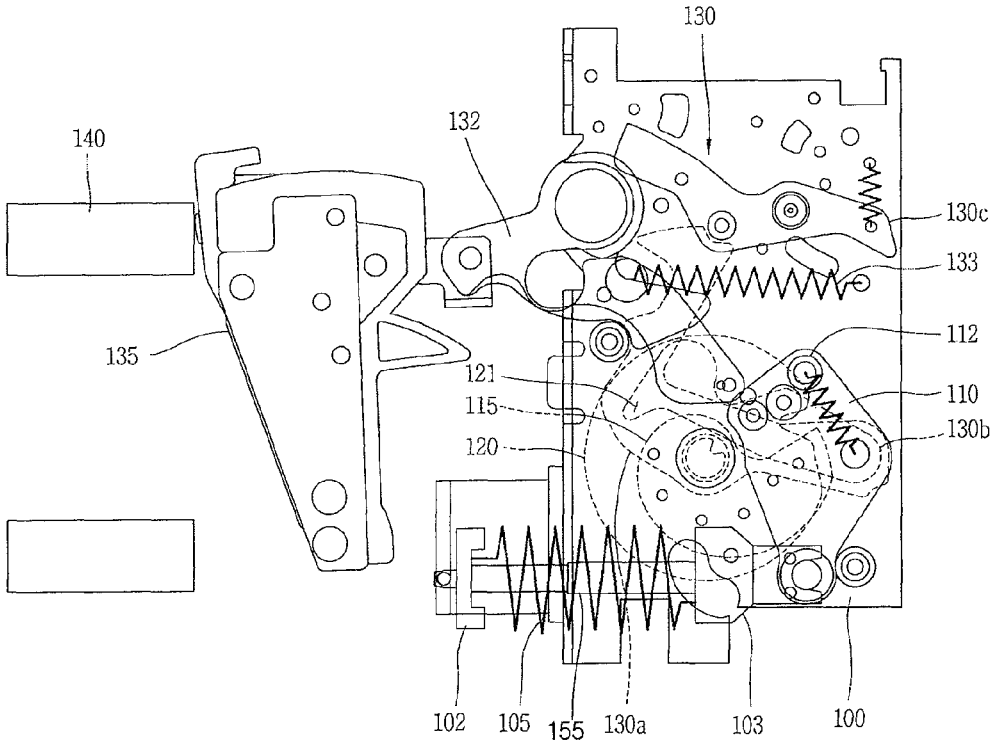
FIG. 6 is an internal front view of a circuit breaker having a cam rotation delaying function in accordance with another embodiment of the present invention.
Figure 7:
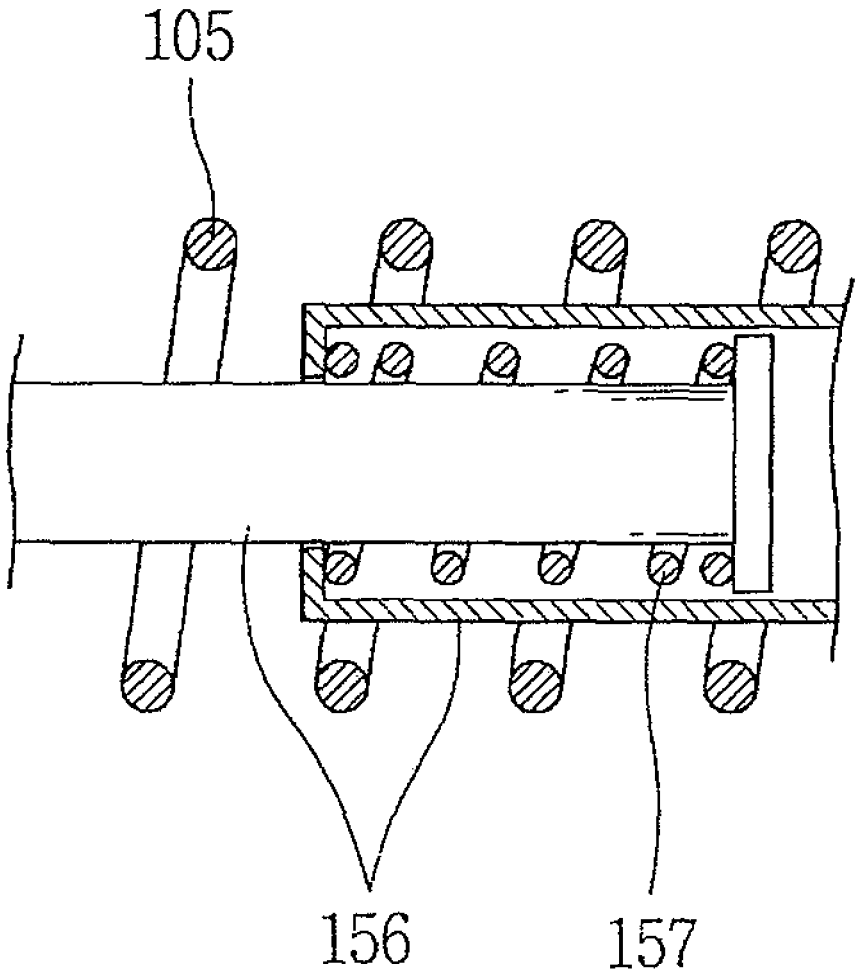
FIG. 7 is a sectional view of a damper of FIG. 6.

FIG. 6 is an internal front view of a circuit breaker having a cam rotation delaying function in accordance with another embodiment of the present invention, and FIG. 7 is a sectional view of a damper of FIG. 6.

As shown in FIG. 6, a circuit breaker having a cam rotation delaying function in accordance with another embodiment of the present invention, which executes a closing operation and a charging operation, may include a plate 100, a closing spring 105, a driving lever 110, a cam 115, a supplementary cam 120, a link mechanism 130, a terminal 140, a movable contact 135 and a damper 155 for attenuating an excessive extension of the closing spring 105, which is further provided compared to the previous embodiment. Here, the plate 100, the closing spring 105, the driving lever 110, the cam 115, the supplementary cam 120, the link mechanism 130, the terminal 140, the movable contact 135 are the same components to those in the previous embodiment, so the detailed description thereof will be omitted.

Here, the damper 155 may be configured to provide a weak damping force when the closing spring 105 is compressed and a strong damping force when the closing spring 105 is extended, thus attenuating a drastic extending speed of the closing spring 105. For example, the damper 155 may be considered to be similar to a door damper which is installed at a door in a link structure so as to allow a rapid opening of the door and slow closing thereof.

Referring to FIG. 7, the damper 155 may be configured by including dual is pipes 156 disposed within the closing spring 105 and slidably coupled to each other to be contracted and extended, and a damping spring 157 disposed between the dual pipes 156 and compressed responsive to extension of the dual pipes 156. That is, when the closing spring 105 is extended, the dual pipes 156 are extended and accordingly the damping spring 157 disposed between the dual pipes 156 is compressed. Hence, the extending speed of the closing spring 105 is reduced and the rotating speed of the driving lever 110 in a counterclockwise direction is also reduced. Cooperatively, an excessive rotating speed of the cam 115 due to the rotation of the link member 130 connected to the driving lever 110 can be reduced. Consequently, the rotation of the cam 115 as excessive as interfering with the rotation of the driving lever 110 can be prevented.

Also, the damper 155 may be configured as a damper in a cylinder type which is disposed outside or inside the closing spring 105 along the closing spring 105 and contains fluid for damping.

In the circuit breaker having the cam rotation delaying function in accordance with the one embodiment of the present invention, the cam delaying mechanism for delaying a returning rotation of the supplementary cam is provided at the circumferential surface of the supplementary cam, which is configured to be rotated with the cam, so as to prevent an excessive rotation of the cam, thereby allowing the stable and complete toggling operation of the link mechanism and the smooth returning of the closing spring, resulting in ensuring more stable operation of the circuit breaker.

The foregoing embodiments and advantages are merely exemplary and are not to be construed as limiting the present disclosure. The present teachings can be readily applied to other types of apparatuses. This description is intended is to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker having a cam rotation delaying function, the circuit breaker performing a closing operation and a charging operation, the circuit breaker comprising:

a plurality of plates spaced apart from each other;

a closing spring having one end portion rotatably coupled to each of the plates;

a driving lever rotatably installed at each of the plates and connected to another end portion of the closing spring so as to be rotated responsive to compression and extension of the closing spring;

a cam rotatably installed at each of the plates and configured to press the driving lever for rotation;

a link mechanism having a plurality of links rotatably installed at each of is the plates and connected to the driving lever for operation;

a movable contact rotatably installed at a side of each of the plates and contactable with a terminal by an operation of the link mechanism; and a cam delaying mechanism installed at each of the plates and configured to attenuate a rotational force of the cam due to a restoring force of the closing spring.

2. The circuit breaker of claim 1, wherein the cam delaying mechanism comprises a delay link elastically rotatably installed at each of the plates and configured to delay the rotation of the cam.

3. The circuit breaker of claim 1, further comprising a supplementary cam installed at the same rotational shaft as that of the cam so as to be cooperatively rotated with the cam and having a rotational radius greater than that of the cam, wherein the plurality of links of the link mechanism are rotatably installed between the plates by virtue of toggle pins and connected to the driving lever so as to be toggled.

4. The circuit breaker of claim 3, wherein the cam delaying mechanism comprises:

a delay link rotatably installed at each of the plates and contactable with the supplementary cam;

a rotation pin inserted into the delay link to be coupled to the plate so as to transfer a rotation of the delay link; and a delay spring installed between the delay link and each plate and configured to elastically support the rotation of the delay link.

5. The circuit breaker of claim 4, wherein the delay link comprises a supporting portion protrudingly formed and slidably inserted into an outer circumferential portion of the supplementary cam.

6. The circuit breaker of claim 4, wherein a contact portion of the delay link with the supplementary cam is formed to be round.

7. The circuit breaker of claim 4, wherein the delay link comprises an accommodation groove, wherein the delay spring comprises a first stopper locked at the accommodation groove and a second stopper locked at the plate.

8. The circuit breaker of claim 4, wherein the supplementary cam comprises a contact groove in which the delay link is detachably inserted.

9. The circuit breaker of claim 3, wherein the supplementary cam is installed at both sides of the rotational shaft, and provided with coupling holes formed along a central portion of the cam, the cam being coupled to the coupling holes.

10. A circuit breaker having a cam rotation delaying function, in a circuit breaker performing a closing operation and a charging operation, the circuit breaker comprising:

a plurality of plates spaced apart from each other;

a closing spring having one end portion rotatably coupled to each of the plates;

a damper installed within the closing spring and contracted and extended in cooperation with the closing spring to attenuate a restoring force of the closing spring;

a driving lever rotatably installed at each of the plates and connected to another end portion of the closing spring so as to be rotated responsive to compression and extension of the closing spring;

a cam rotatably installed at each of the plates and configured to press the driving lever for rotation;

a supplementary cam installed at the same rotational shaft as that of the cam so as to be cooperatively rotated with the cam and having a rotational radius greater than that of the cam;

a link mechanism having a plurality of links rotatably installed between the plates by virtue of toggle pins and connected to the driving lever so as to be toggled; and a movable contact rotatably installed at a side of each of the plates and contactable with a terminal by an operation of the link mechanism.

11. The circuit breaker of claim 10, wherein the damper is configured as dual pipes provided with a through hole for allowing air flow responsive to compression and extension of the closing spring, the dual pipes being slidably coupled to each other so as to be contracted and extended.

* * * * *